US007239079B2

(12) United States Patent
Choi et al.

(10) Patent No.: US 7,239,079 B2
(45) Date of Patent: Jul. 3, 2007

(54) FIELD EMISSION DISPLAY AND MANUFACTURING METHOD THEREOF

(75) Inventors: Jun-Hee Choi, Suwon-si (KR); Andrei Zoulkarneev, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/151,216

(22) Filed: Jun. 14, 2005

(65) Prior Publication Data

US 2006/0290288 A1 Dec. 28, 2006

(30) Foreign Application Priority Data

Feb. 7, 2005 (KR) ..... 10-2005-0011417

(51) Int. Cl.
*H01J 1/62* (2006.01)
*H01J 1/46* (2006.01)

(52) U.S. Cl. ..... 313/497; 313/509; 313/306

(58) Field of Classification Search ..... 313/483, 313/495, 496, 497, 506, 509, 306, 307, 310; 315/326, 334, 160, 167; 445/66, 67, 23, 445/24, 29, 33

See application file for complete search history.

(56) References Cited

U.S. PATENT DOCUMENTS

| | | | | |
|---|---|---|---|---|
| 5,214,347 | A * | 5/1993 | Gray | 313/355 |
| 5,384,509 | A * | 1/1995 | Kane et al. | 313/309 |
| 5,723,052 | A * | 3/1998 | Liu | 216/25 |
| 6,181,060 | B1 * | 1/2001 | Rolfson | 313/495 |
| 6,204,597 | B1 * | 3/2001 | Xie et al. | 313/310 |
| 6,441,550 | B1 * | 8/2002 | Patterson et al. | 313/495 |
| 6,710,534 | B2 * | 3/2004 | Patterson et al. | 313/446 |

* cited by examiner

*Primary Examiner*—Thuy Vinh Tran
(74) *Attorney, Agent, or Firm*—Robert E. Bushnell, Esq.

(57) ABSTRACT

A field emission display and a method of making the same. The field emission display uses a deflection electrode having at least two elements. By applying different combinations of voltages to these two elements of the deflection electrode, the direction that the electron beam travels can be carefully controlled so that it lands on the proper pixel and subpixel. A protective electrode can be further included to prevent static charge buildup on the structure and to prevent dispersion of the electron beam.

25 Claims, 16 Drawing Sheets

FIELD EMISSION DISPLAY AND MANUFACTURING METHOD THEREOF

CLAIM OF PRIORITY

This application makes reference to, incorporates the same herein, and claims all benefits accruing under 35 U.S.C. § 119 from an application earlier filed in the Korean Intellectual Property Office on 7 Feb. 2005 and there duly assigned Ser. No. 10-2005-0011417.

BACKGROUND OF THE INVENTION

1. Field of the Invention

The present invention relates to a field emission display, and more particularly, to a field emission display and a manufacturing method thereof. The field emission display deflects an electron beam by providing a deflection electrode on a rear substrate on which a cold cathode is formed. The field emission display can also have a protective electrode on an uppermost layer of the rear substrate to improve the reliability of the display.

2. Description of the Related Art

Generally, a field emission display applies an electric field from a gate electrode to emitters arranged on a cathode and spaced apart from one another by a predetermined interval to cause the emitters to emit an electron beam. The emitted electron beam collide with a phosphor layer on an anode that is held at a high voltage to thus cause the phosphor layer to emit light.

Designs for field emission displays have many limitations. Often, the data lines leading to the emitters are too narrow, resulting in a voltage drop along the data lines. Also, the color purity of field emission displays are limited when electron beams hit the wrong pixel or the wrong subpixel. Attempts to solve the data line problem often result in an field emission display that has poor color purity and vice versa. Therefore, what is needed is a design for a field emission display and a method of making the display that both reduces voltage drops along the data lines while maintaining superior color purity.

SUMMARY OF THE INVENTION

It is therefore an object of the present invention to provide an improved design for a field emission display.

It is also an object of the present invention to provide a method of making the improved field emission display.

It is further an object of the present invention to provide a design for a field emission display that reduces voltage drops along data lines while achieving superior color purity.

It is yet an object of the present invention to provide a method of making a field emission display that has little voltage drop along the data lines and has superior color purity characteristics.

These and other objects can be achieved by a field emission display and a manufacturing method thereof, that can deflect an electron beam with a relatively low voltage by providing a deflection electrode on a rear substrate that is capable of adjusting the direction of the electron beam, and can improve display reliability by providing a protective layer on an uppermost layer of the rear substrate.

According to an aspect of the present invention, there is provided a field emission display that includes a rear substrate, a cathode arranged on the rear substrate, an emitter arranged on the cathode, a first dielectric layer arranged on the cathode, a first through hole corresponding to the emitter being arranged in the first dielectric layer, a gate electrode arranged on the first dielectric layer, a gate aperture corresponding to the emitter being arranged in the gate electrode, a second dielectric layer arranged on the gate electrode, a second through hole corresponding to the emitter being arranged in the second dielectric layer, a deflection electrode arranged on the second dielectric layer, the deflection electrode having at least two elements symmetrically arranged to face each other with the emitter therebetween, a third dielectric layer arranged on the deflection electrode, a third through hole corresponding to the emitter being arranged in the third dielectric layer, and a protective electrode arranged on the third dielectric layer, the protective electrode having a hole corresponding to the emitter.

The emitter can be formed through the growth of a carbon nanotube (CNT) or the coating of CNT paste. The deflection electrode can deflect an electron beam emitted from the emitter by a symmetrical or asymmetrical electric filed. A predetermined low voltage can be applied to the protective electrode so that the electron beam can be focused without being dispersed and positively-charged particles can be prevented from accumulating in a vacuum space of the field emission display.

According to another aspect of the present invention, there is provided a field emission display that includes a rear substrate, a cathode arranged on the rear substrate in parallel stripes, an emitter arranged on the cathode and spaced apart from the cathode, a first dielectric layer arranged on the cathode, a first through hole corresponding to the emitter being arranged in the first dielectric layer, a gate electrode arranged on the first dielectric layer in parallel stripes intersecting the parallel stripes of the cathode, a gate aperture corresponding to the emitter being arranged in the gate electrode, a second dielectric layer arranged on the gate electrode, a second through hole corresponding to the emitter being arranged in the second dielectric layer, a deflection electrode arranged on the second dielectric layer intersecting the gate electrode and corresponding in parallel with the cathode, the deflection electrode having at least two elements symmetrically arranged to face each other with the emitter therebetween, a third dielectric layer arranged on the deflection electrode, a third through hole corresponding to the emitter being arranged in the third dielectric layer, and a protective electrode arranged on the third dielectric layer, the protective electrode having a hole corresponding to the emitter.

Here, one emitter formed on the rear substrate can correspond to one pixel that is made up of subpixels of various colored phosphor layers formed on a front substrate. The brightness of each pixel can be determined through combinations of a voltages applied to the cathode and the gate electrode. The color subpixel that the electron beam lands on is determined by voltages applied to the deflection electrode.

The field emission display can include a deflection voltage controlling unit for adjusting a voltage applied across the deflection electrode, and a front substrate disposed to be spaced apart from the rear substrate by a predetermined distance. An anode can be formed on a surface of the front substrate that faces the rear substrate, and various colored parallel phosphor layers can be formed on the anode.

The deflection voltage controlling unit can apply voltages of several deflection modes to the deflection electrode. The direction of an electron beam emitted from the emitter can be adjusted through combination of voltages according to the respective deflection modes. Accordingly, an electron beam according to each deflection mode can be transferred to a corresponding colored phosphor layer formed on the anode of the front substrate.

The pixel can be made of R/G/B parallel subpixels disposed on the anode. The deflection voltage controlling unit can cause electron beams of the same brightness signal to be sequentially transferred to the R/G/B subpixels so that a desired color image can be formed by the resulting afterimage.

According to a further aspect of the present invention, there is provided a method for manufacturing a field emission display, the method including forming a cathode of a predetermined pattern on a rear substrate, depositing sequentially a resistor layer, a first dielectric layer and a first metal layer on the cathode, patterning the first metal layer to form a gate electrode, depositing sequentially a second dielectric layer and a second metal layer on the gate electrode, patterning the second metal layer to form a deflection electrode, forming an emitter aperture through an etching process so that the cathode is exposed at a position where the emitter is to be arranged and forming an emitter in the emitter aperture, the emitter comprises a carbon nanotube.

According to a still further aspect of the present invention, there is provided a method for manufacturing a field emission display, the method including forming a cathode of a predetermined pattern on a rear substrate, depositing sequentially a resistor layer, a first dielectric layer and a first metal layer on the cathode, patterning the first metal layer to form a gate electrode, depositing sequentially a second dielectric layer and a second metal layer on the gate electrode, patterning the second metal layer to form a deflection electrode, depositing sequentially a third dielectric layer and a third metal layer on the deflection electrode, patterning the third metal layer to form a protective electrode, forming an emitter aperture through an etching process so that the cathode is exposed at a position where the emitter is to be arranged and forming an emitter in the emitter aperture, the emitter comprises a carbon nanotube.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
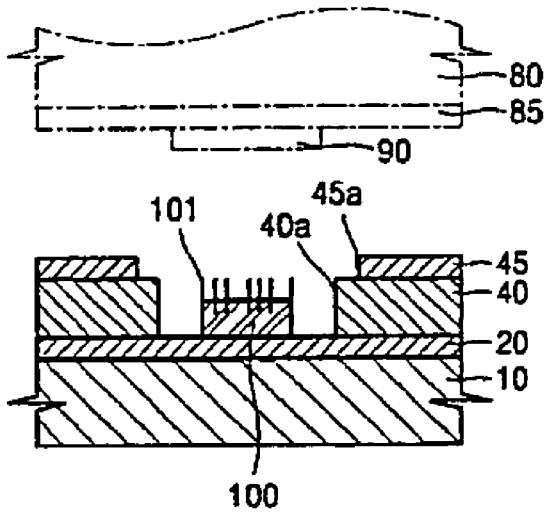
FIG. 1 is a sectional view of a field emission display.

Turning now to the figures, FIG. 1 is a sectional view illustrating a structure of a field emission display. Referring to FIG. 1, in the field emission display, a cathode 20 is provided on a rear substrate 10, and a first dielectric layer 40 and a metal gate electrode 45 are sequentially deposited on the rear substrate 10. A gate aperture 45*a* and a first through hole 40*a* are respectively formed in the gate electrode 45 and the first dielectric layer 40 in such a way that they communicate with each other. The cathode 20 is partially exposed at the bottom of the first through hole 40*a*, and an emitter 100 (that is, an electron emission source) is formed on the exposed cathode 20. The emitter 100 can be formed through the growth or deposition of a carbon nanotube (CNT) 101.

A cold cathode device in the above structure is formed on the rear substrate 10, and a front substrate 80 is situated in front of the rear substrate 10 and is spaced apart from the cold cathode device by a predetermined distance. An anode 85, to which a high voltage is applied, is provided on a rear surface (that is, a surface facing the rear substrate 10) of the front substrate 80, and a phosphor layer 90 is provided on the anode 85.

Figure 2:
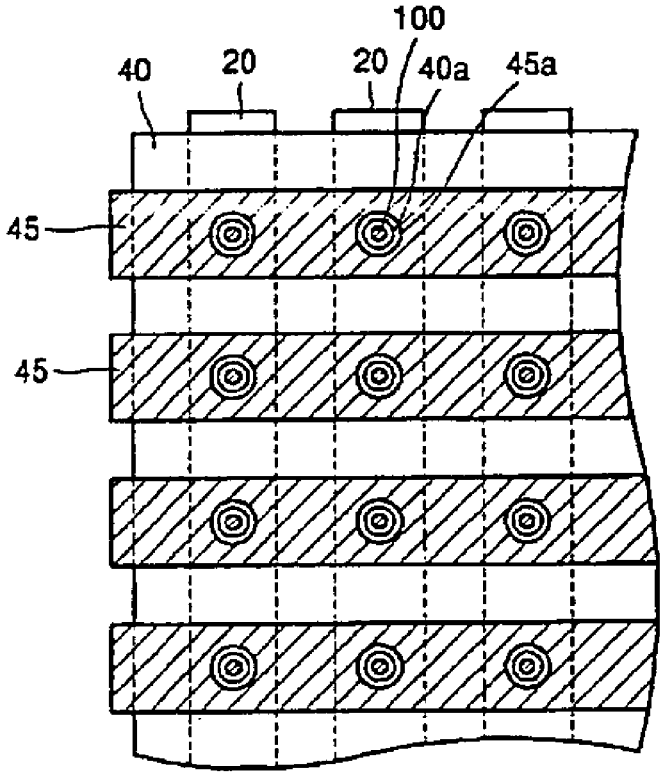
FIG. 2 is a plan view of a cold cathode of a field emission display.

Turning now to FIG. 2, FIG. 2 is a plan view of a cold cathode of a field emission display. Referring to FIG. 2, cathodes 20 are formed on a substrate (not shown) in parallel stripes, a first dielectric layer 40 is formed on the cathodes 20, and gate electrodes 45 are formed on the first dielectric layer 40 in parallel stripes perpendicular to the cathodes 20. Gate aperture 45*a* and first through holes 40*a* are formed at locations where the cathodes 20 and the gate electrodes 45 intersect each other, and emitters 100 are formed at the bottoms of the first through holes 40*a*. Generally, a data voltage is applied to each cathode 20, and a scanning voltage is applied to each gate electrode 45.

Figure 3:
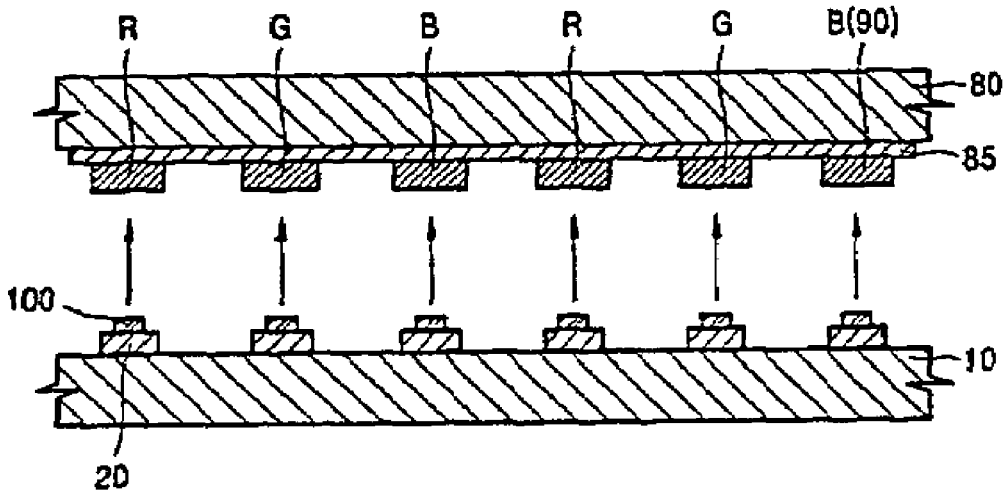
FIG. 3 is a sectional view illustrating a color reproduction method where emitters are in 1:1 correspondence with phosphor layers.

Turning now to FIG. 3, FIG. 3 is a sectional view illustrating a color reproduction method where emitters are in 1:1 correspondence with phosphor layers. Referring to FIG. 3, when R/G/B phosphor layers constitute one pixel, R/G/B subpixels each correspond to each emitter 100. While this method can lower a frame frequency, it has drawbacks in that the size of the emitter 100 is reduced and the width of a data line for applying a data voltage to the emitter 100 is narrowed. Increased data line resistance due to the narrowed data line width tends to cause a problem when a high-resolution image is reproduced.

Figure 4:
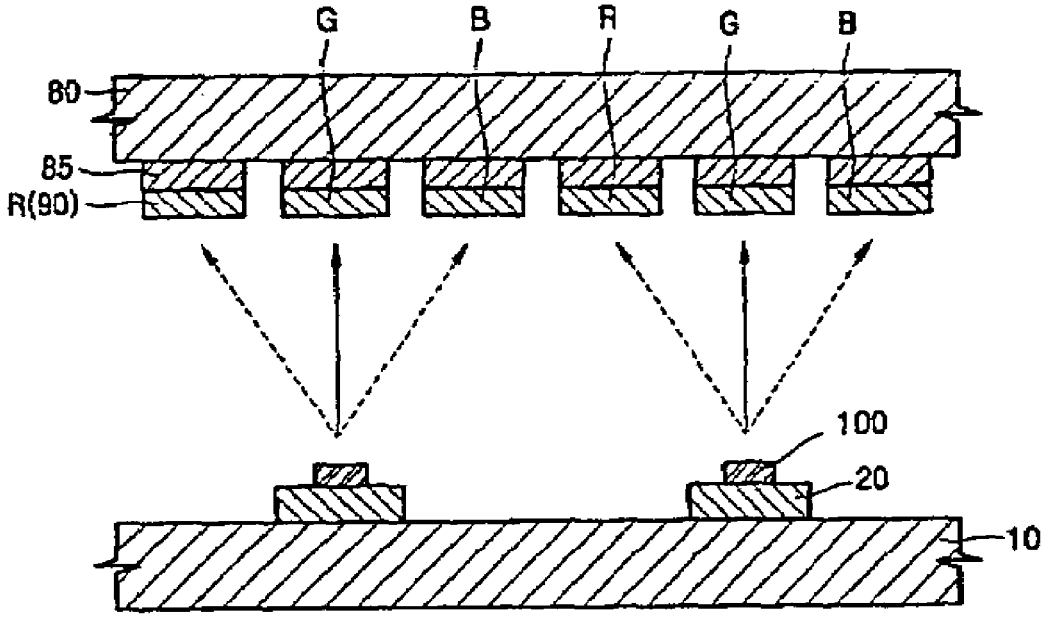
FIG. 4 is a sectional view illustrating a color reproduction method where emitters are in 1:3 correspondence with phosphor layers.

To solve the problem caused by the increased data line resistance, there has been proposed a method of exciting three subpixels by one emitter. FIG. 4 is a sectional view illustrating a color reproduction method where emitters are in 1:3 correspondence with phosphor layers. Referring to FIG. 4, R/G/B phosphor layers 90 constitute one pixel, and one emitter 100 corresponds to one pixel. Three anodes 85 are respectively provided on the bottoms of the R/G/B phosphor layers 90, and a high voltage is alternately applied to the three anodes 85 so that an electron beam is attracted to each phosphor layer.

However, while this method can provide a data line width three times larger than that in the method shown in FIG. 3, it undesirably has an increased frame frequency three times larger than that in the method shown in FIG. 3 because it must reproduce respective R/G/B signals so as to reproduce one frame image. Specifically, a residual voltage tends to be generated in the anodes because a high voltage of up to several kV must be switched in the anodes at a high frequency. In this case, a part of electron beams are transferred toward a neighboring phosphor layer, causing color purity to be degraded. When a voltage of the anode is lowered to prevent the degradation of color purity, luminance can be degraded.

Figure 5:
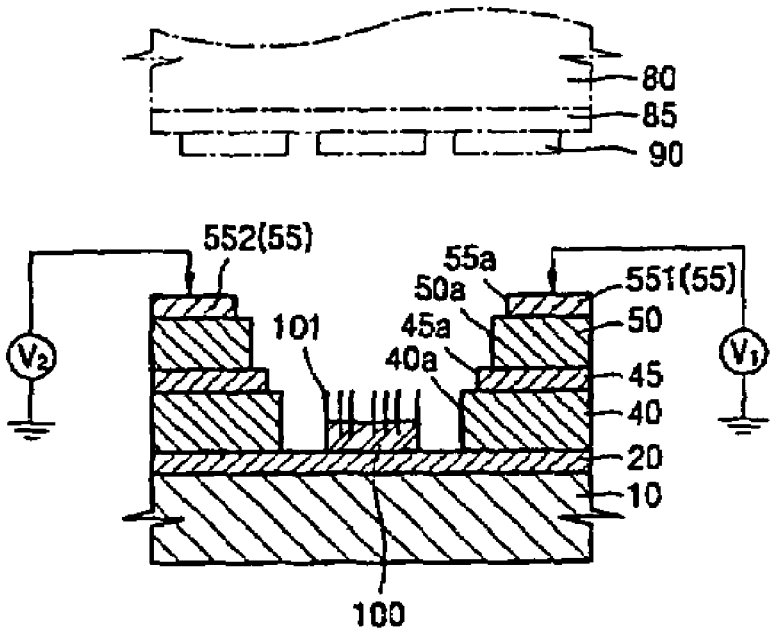
FIG. 5 is a sectional view of a field emission display equipped with a deflection electrode according to the present invention.

Turning now to FIG. 5, FIG. 5 is a sectional view of a field emission display equipped with a deflection electrode according to the present invention. Referring to FIG. 5, the inventive field emission display includes a rear substrate 10 on one side of which a cold cathode device is formed, and a front substrate 80 arranged spaced apart from the rear substrate 10 by a predetermined distance. Space between the rear substrate 10 and the front substrate 80 is maintained in a vacuum state.

The inventive field emission display further includes a cathode 20 formed on the rear substrate 10, an emitter 100 formed of a carbon nanotube, a gate electrode 45 formed on the cathode 20 in such a way to be isolated from the cathode 20, and a deflection electrode 55 formed on the gate electrode 45.

The deflection electrode 55 includes at least two elements facing each other with the emitter 100 between them. When one deflection axis is necessary for controlling the direction of an electron beam, the deflection electrode 55 can operate by applying voltages to the first and second elements.

A voltage $V_1$ and a voltage $V_2$ are applied respectively to first element 551 and second element 552 of the deflection electrode 55. When $V_1$ equals $V_2$, a symmetrical electric field is formed within an emitter aperture so that an electron beam emitted from the emitter 100 travels straight. On the contrary, when $V_1$ differs from $V_2$, an asymmetrical electric field is formed within the emitter aperture so that the electron beam emitted from the emitter 100 is deflected to one side.

Meanwhile, an anode 85 is formed on a side of the front substrate 80 that faces the rear substrate 10, and parallel phosphor layers 90 of various colors are formed on the anode 85. Accordingly, an electron beam deflected by the deflection electrode 55 reaches one of the phosphor layers 90 can cause that phosphor layer to emit light. Here, the phosphor layers 90 can include R/G/B subpixels, and one pixel is made up of three subpixels, each pixel corresponding to one emitter 100.

Figure 6:
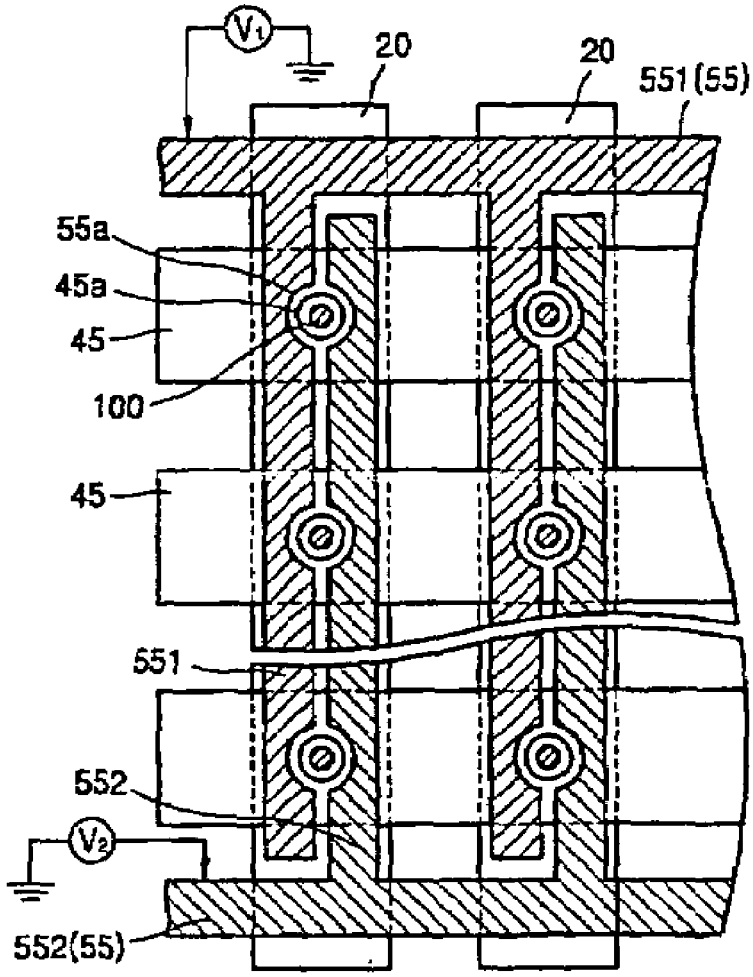
FIG. 6 is a plan view of a field emission display equipped with a deflection electrode according to a first embodiment of the present invention.

Turning now to FIG. 6, FIG. 6 is a plan view of a field emission display equipped with a deflection electrode according to a first embodiment of the present invention. In FIG. 6, a portion of a cold cathode device formed on a rear substrate is illustrated with an dielectric layer being omitted for simplicity. Referring to FIG. 6, cathodes 20 and gate electrodes 45 are formed in intersected stripes, emitters 100 are formed on the cathodes 20 at intersected locations of the stripes, and deflection electrodes 55 are formed on the gate electrodes 45 in such a way as to be parallel with the cathodes 20.

Two elements of the deflection electrode 55 are symmetrically arranged to face each other with the emitter 100 between them. Here, first elements 551 of deflection electrodes passing by the left side of the emitter 100 are connected with one another, and second elements 552 of deflection electrodes passing by the right side of the emitter 100 are connected with one another. A voltage $V_1$ and a voltage $V_2$ are applied respectively to the first element 551 and the second element 552, and the direction of an electron beam can be adjusted as described above.

The deflection electrodes 55 have arc portions at their inner sides and are arranged to surround the emitter 100 through the arc portions so that an average gap between the deflection electrodes 55 and the emitter 100 can be reduced. The magnitude of the voltages applied to the deflection electrodes 55 are determined based on signal voltages applied to the cathode 20 and the gate electrode 45 and the distance between the deflection electrodes 55 and an anode. When $V_1$ and $V_2$ are both negative voltages, the deflection electrodes 55 can simultaneously function as focusing gates because they have the arc portions surrounding the emitter 100.

Figure 7:
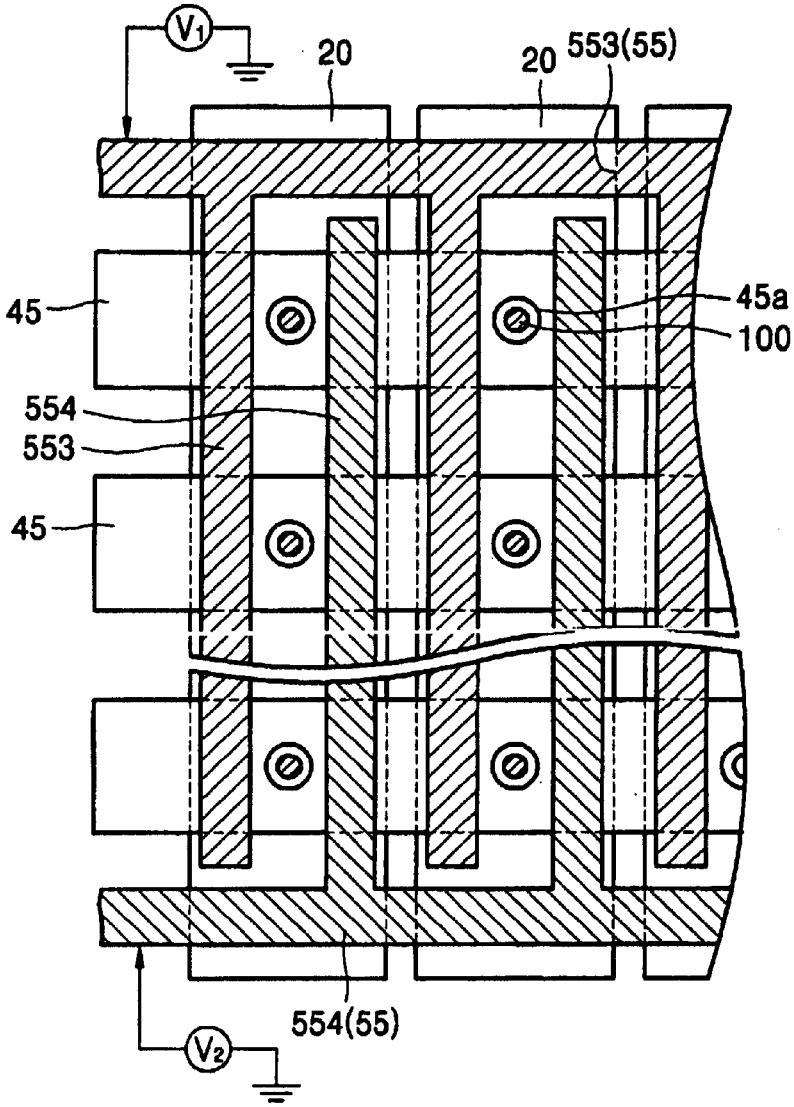
FIG. 7 is a plan view of a field emission display equipped with a deflection electrode according to a second embodiment of the present invention.

Turning now to FIG. 7, FIG. 7 is a plan view of a field emission display equipped with a deflection electrode according to a second embodiment of the present invention. In FIG. 7, a portion of a cold cathode device including a cathode, a gate electrode and a deflection electrode on a rear substrate are illustrated with an dielectric layer being omitted for simplicity.

Referring to FIG. 7, the second embodiment is substantially the same as the first embodiment with the exception that the shape of a deflection electrode 55 in the second embodiment is different from that in the first embodiment. That is, in the second embodiment, a first element 553 of the deflection electrode and a second element 554 of the deflection electrode are respectively formed at both sides of the emitter aperture in a straight-line shape with no arcs. It should be noted that the deflection electrode 55 can have shapes other than those in the first and second embodiments.

Figure 8:
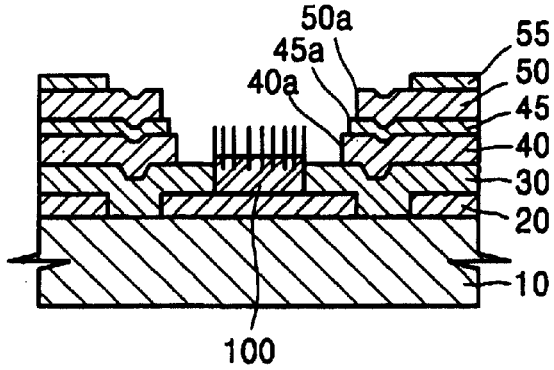
FIG. 8 is a sectional view of a field emission display equipped with a deflection electrode according to a third embodiment of the present invention.

Turning now to FIG. 8, FIG. 8 is a sectional view of a field emission display equipped with a deflection electrode according to a third embodiment of the present invention. Referring to FIG. 8, in the third embodiment, a resistive element 30 is further provided between the cathode 20 and a first dielectric layer 40 so that electrons supplied from the cathode 20 can be transferred uniformly to all parts of the emitter 100. The resistive element 30 functions as a ballast resistor, enabling the lifetime of the emitter 100 by preventing electrons from concentrating on one part of the emitter.

These features of the above embodiments can be applied to other embodiments of the present invention. For example, FIG. 9 is a sectional view of a field emission display equipped with a deflection electrode and a protective electrode according to the present invention.

Figure 9:
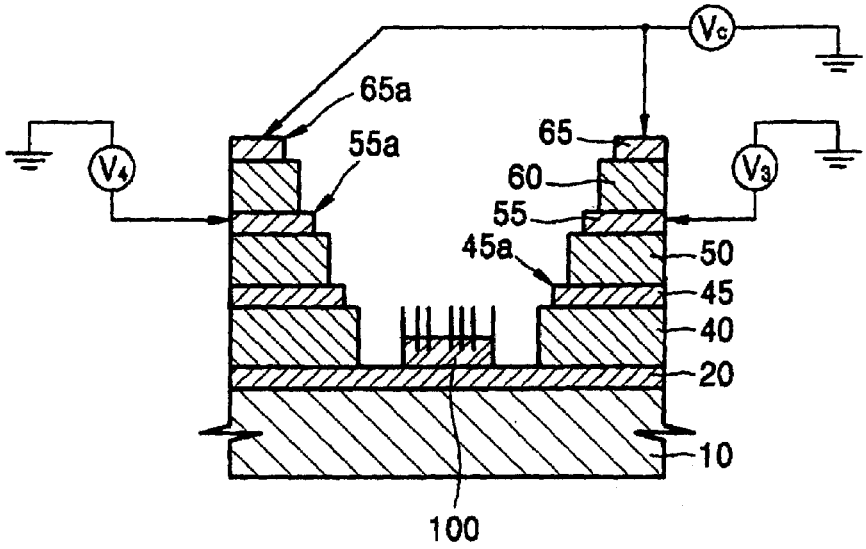
FIG. 9 is a sectional view of a field emission display equipped with a deflection electrode and a protective layer according to the present invention.

Referring to FIG. 9, an inventive field emission display includes a third dielectric layer 60 formed on a deflection electrode 55, and a protective electrode 65 formed on the third dielectric layer 60. A third through hole communicating with the first and second through holes is formed in the third dielectric layer 60, and the protective electrode 65 is patterned to have an aperture 65*a* corresponding to the third through hole.

A predetermined low voltage Vc is applied to the protective electrode 65. Accordingly, an electron beam deflected by the deflection electrode 55 can reach a targeted subpixel without being dispersed. Voltages $V_3$ and $V_4$ applied to the deflection electrode 55 can be identical to or different from each other according to whether or not the electron beam has been deflected, and can be concretely determined according to the relationships among them and Vc and a gate electrode voltage.

Figure 10A:
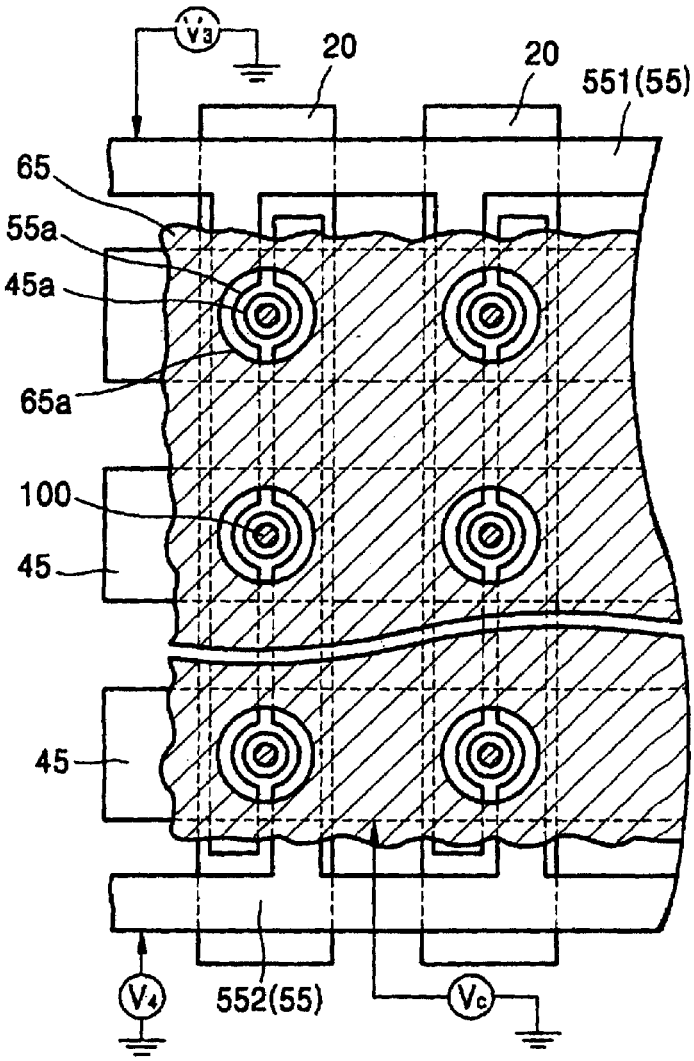
FIGS. 10A and 10B are plan views of a field emission display equipped with a deflection electrode and a protective electrode according to a fourth embodiment of the present invention.

Turning now to FIG. 10A, FIG. 10A is a plan view of a field emission display equipped with a deflection electrode and a protective layer according to a fourth embodiment of the present invention. FIG. 10A illustrates a portion of a cold cathode device formed on a rear substrate with an dielectric layer being omitted for simplicity.

Referring to FIG. 10A, in the fourth embodiment, a third dielectric layer (not shown) is formed on a deflection electrode 55, and a protective electrode 65 is formed on the third dielectric layer. The protective electrode 65 can be formed in a body with respect to the whole surface of the cold cathode device. An aperture 65*a* is formed at a position corresponding to each emitter so that the same structure as a general focusing gate is obtained.

As described above, the protective electrode 65 is held at voltage Vc which is a low voltage, causing the protective electrode to function as a focusing gate. In addition, the protective electrode can prevent the accumulation of positively-charged particles generated at the vacuum space of the field emission display. Accordingly, the protective electrode 65 can protect the field emission display from various problems that can be caused by static electricity of high voltage.

In a general field emission display, a front substrate and a rear substrate are installed to be spaced apart from each other by a predetermined distance using a spacer. A circumference portion of the space between the front and the rear substrates are sealed, and the inner space within the seal is maintained in a near vacuum state of about $10^{-6}$ through $10^{-5}$ mbar. However, since the inner space is not a perfect vacuum state, gas molecules still exists in the inner space and these gas molecules can become positively charged by the inner environment of the display that has a high positive polarity. When these positively-charged particles accumulate in a dielectric layer, a static charge of high voltage is formed and an arcing can occur due to a breakdown between the accumulated charge and the emitters or the metal electrodes. Such a breakdown causes the conductivity of a ballast resistor (that is, a semiconductor) to be changed. In this embodiment, the protective electrode 65 is formed using metal having high conductivity so that the accumulation of the positive charge is prevented and thus the cold cathode device formed on the rear substrate 10 is protected.

Figure 10B:
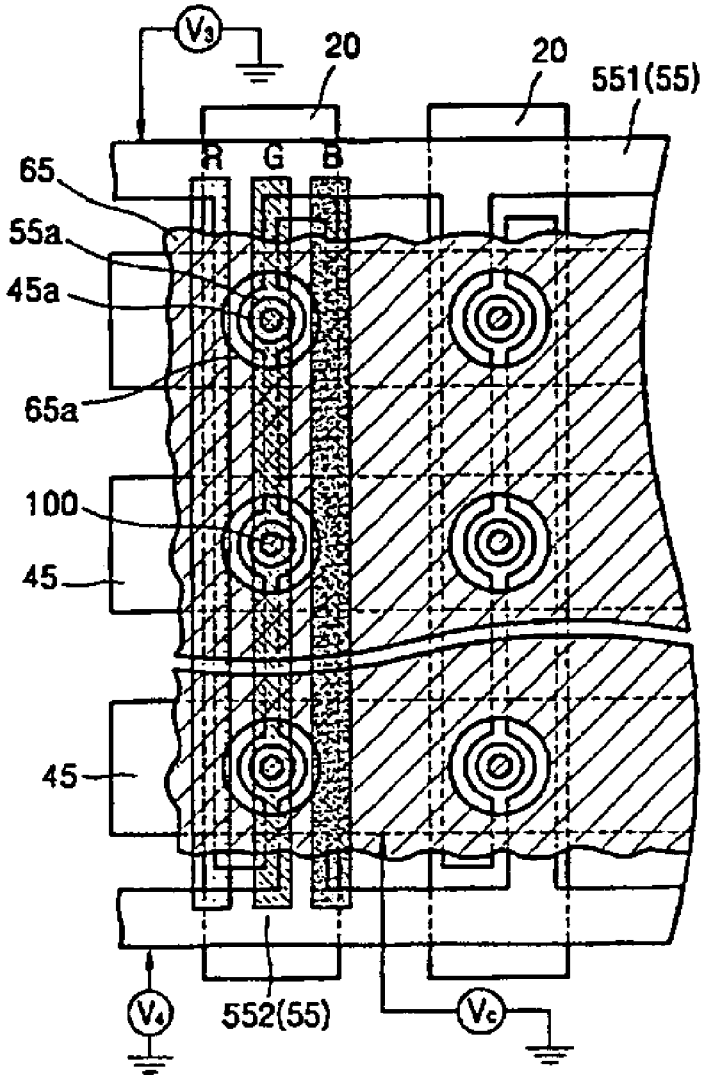

Turning now to FIG. 10B, FIG. 10B illustrates the spatial relationships of the above components formed on the rear substrate with R/G/B phosphor layers formed on the front substrate of the field emission display of FIG. 10A. Referring to FIG. 10B, a G phosphor layer is arranged directly above the front of an emitter and thus receive straight-traveled electrons. R/B phosphor layers are arranged respectively at both sides of the emitter to thus respectively receive electrons deflected left and right by the deflection electrode 55.

Figure 11:
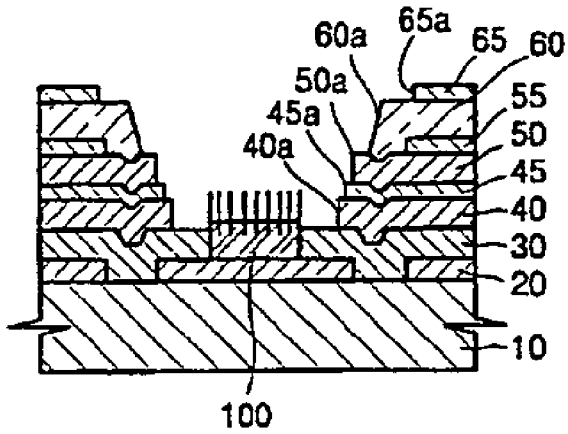
FIG. 11 is a plan view of a field emission display equipped with a deflection electrode and a protective layer according to a fifth embodiment of the present invention.

Turning now to FIG. 11, FIG. 11 is a plan view of a field emission display equipped with a deflection electrode and a protective layer according to a fifth embodiment of the present invention. Referring to FIG. 11, a ballast resistor 30 is further provided between the cathode 20 and the emitter 100 when compared with the embodiment shown in FIG. 9 so that electrons supplied from the cathode 20 can be uniformly supplied through the ballast resistor 30 to all parts of the emitter 100.

Figure 12:
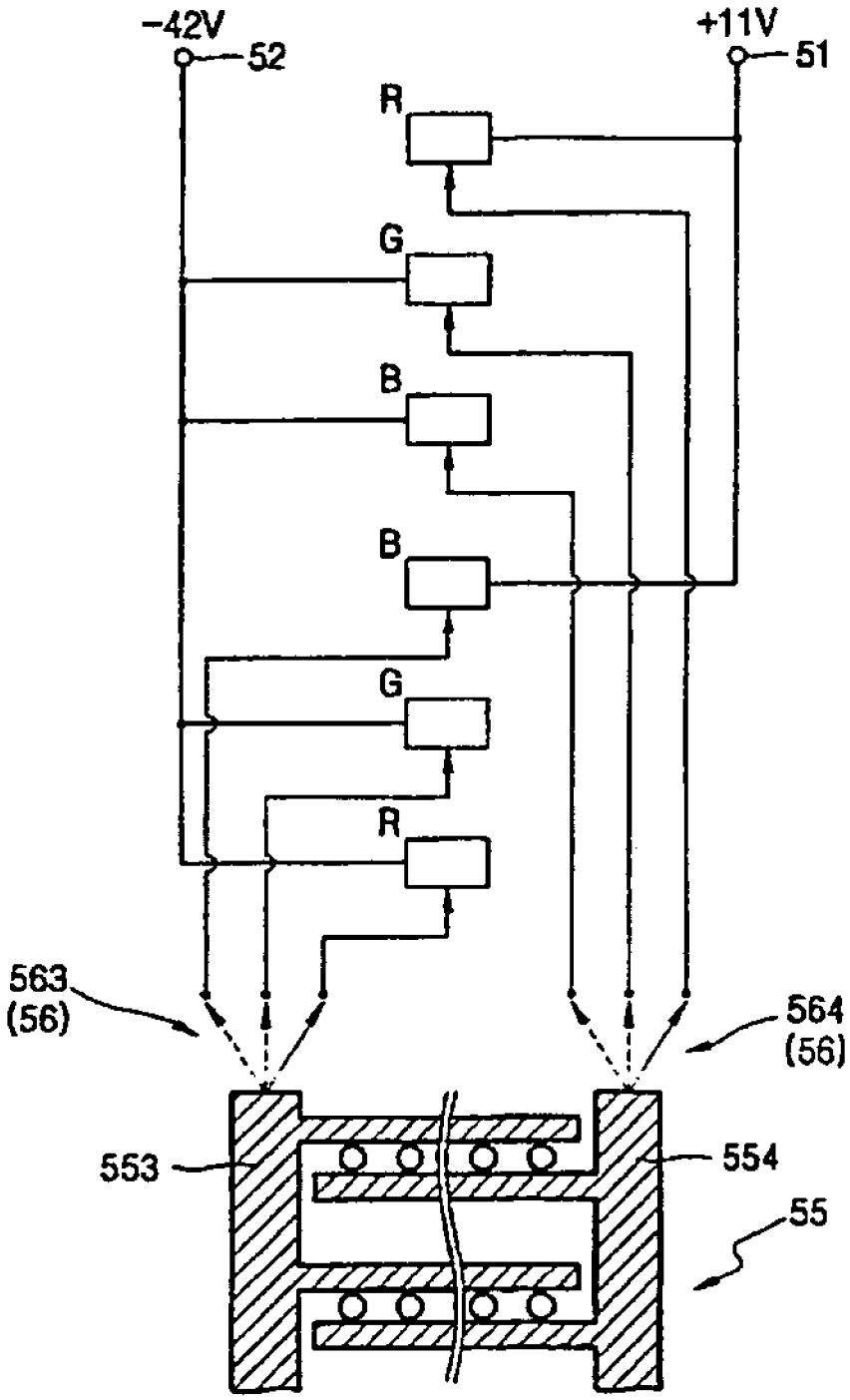
FIG. 12 is a view illustrating a deflection voltage controlling unit according to a first embodiment of the present invention.

Turning now to FIG. 12, FIG. 12 is a view illustrating a deflection voltage controlling unit according to a first embodiment of the present invention. Referring to FIG. 12, voltages of three deflection modes are applied to the first and second elements 553 and 554 of the deflection electrodes, and an electron beam emitted from the emitter is transferred selectively to one of a R, G and B phosphor layers. Voltages +11V and −42V are supplied respectively to two voltage input ports 51 and 52, and three combinations of output port voltages, that is, R(−42V, +11V), G(−42V, −42V) and B(+11V, −42V) are obtained through a predetermined switching circuit.

Switches 563 and 564 provided respectively to input ports of the first and second elements 553 and 554 of the deflection electrodes are sequentially connected to the three output ports so that the three combinations of the output port voltages are applied to the deflection electrodes. Three switching operations for each of R/G/B colors are necessary for reproducing one color. Accordingly, when a frame frequency is 60 Hz, switch 56 is switched at the rate of 180 Hz.

The magnitude of a voltage applied to the deflection electrode 55 is determined based on the voltage relationship between the gate electrode and the protective electrode. However, since generally determined within a low voltage range of about −200V through +200V, the applied voltage does not cause a problem that can be generated due to a residual voltage, even when the switch 56 is switched at the rate of 180 Hz.

Figure 13:
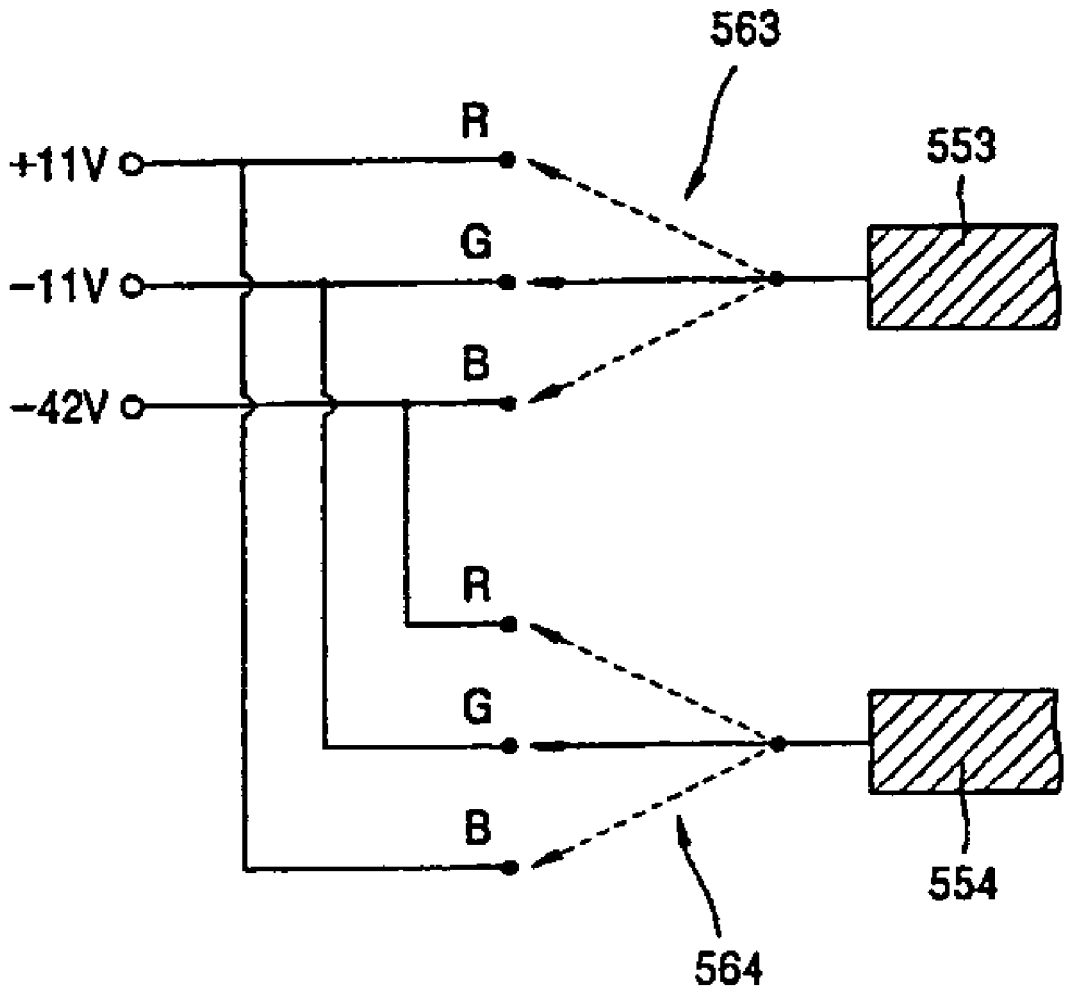
FIG. 13 is a view illustrating a deflection voltage controlling unit according to a second embodiment of the present invention.

Turning now to FIG. 13, FIG. 13 is a view illustrating a deflection voltage controlling unit according to a second embodiment of the present invention. Referring to FIG. 13, combinations of voltages applied to the first and second elements of the deflection electrodes 553 and 554 can be provided in three R/G/B deflection modes as the first embodiment illustrated in FIG. 12.

Figure 14:
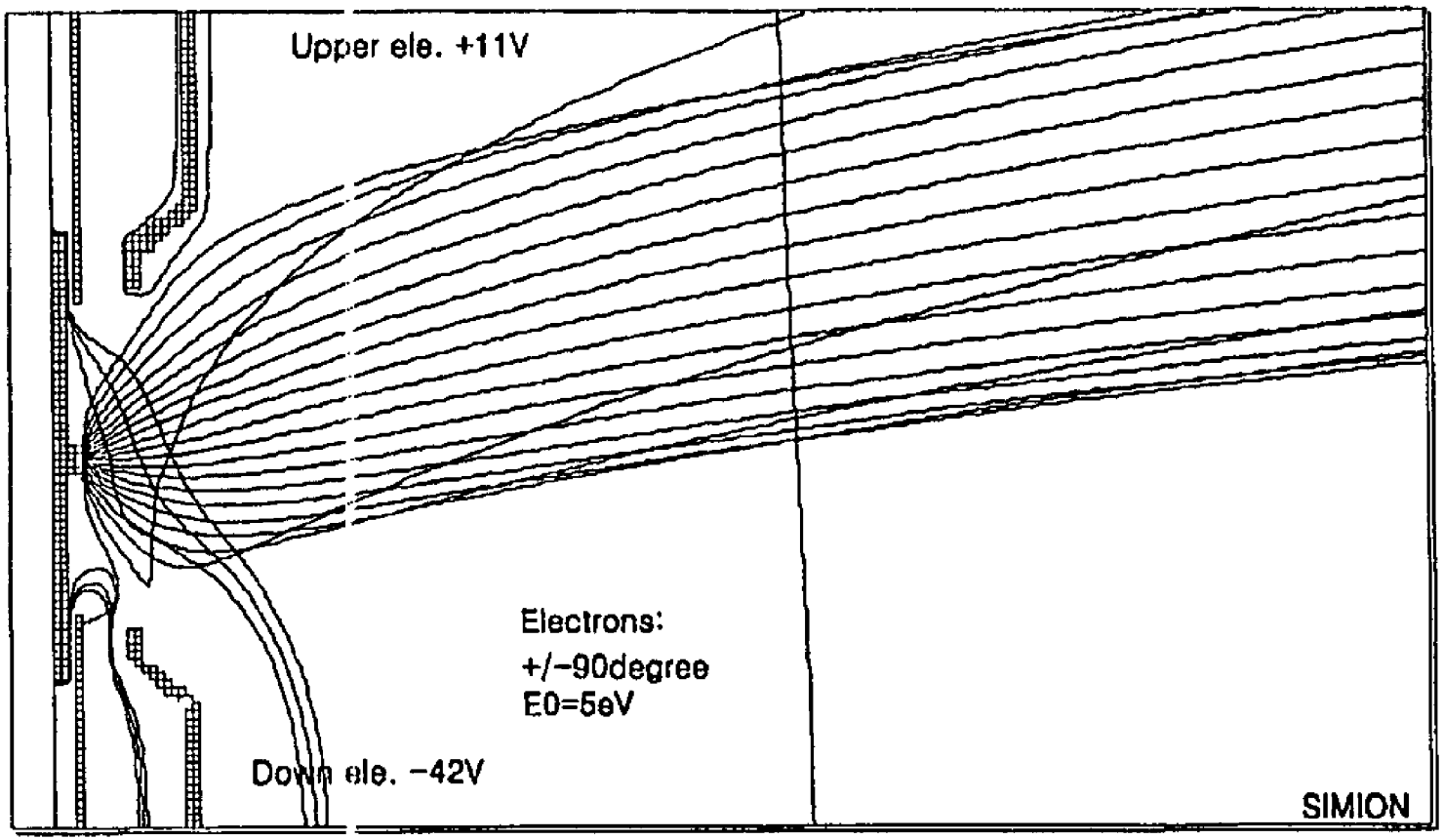
FIG. 14 is a view illustrating a trajectory of an electron beam emitted when a voltage of an R deflection mode is applied to a deflection electrode of a field emission display equipped with the deflection electrode according to the present invention.

Turning now to FIG. 14, FIG. 14 is a view illustrating a trajectory of electron beam emitted when a voltage of an R deflection mode is applied to a deflection electrode of a field emission display equipped with the deflection electrode according to the present invention. Specifically, FIG. 14 illustrates an electron trajectory simulation result when a gate voltage is 180V, an anode voltage is 2.5 kV, −42V is applied to the first element of the deflection electrode (Down ele in FIG. 14), and +11V is applied to the second element of the deflection electrode (Upper ele in FIG. 14). It can be known from the simulation result that an electron beam of a negative charge is deflected toward the second deflection electrode 554 of positive voltage so that the electron beam can land on a R phosphor layer (not shown).

Figure 15:
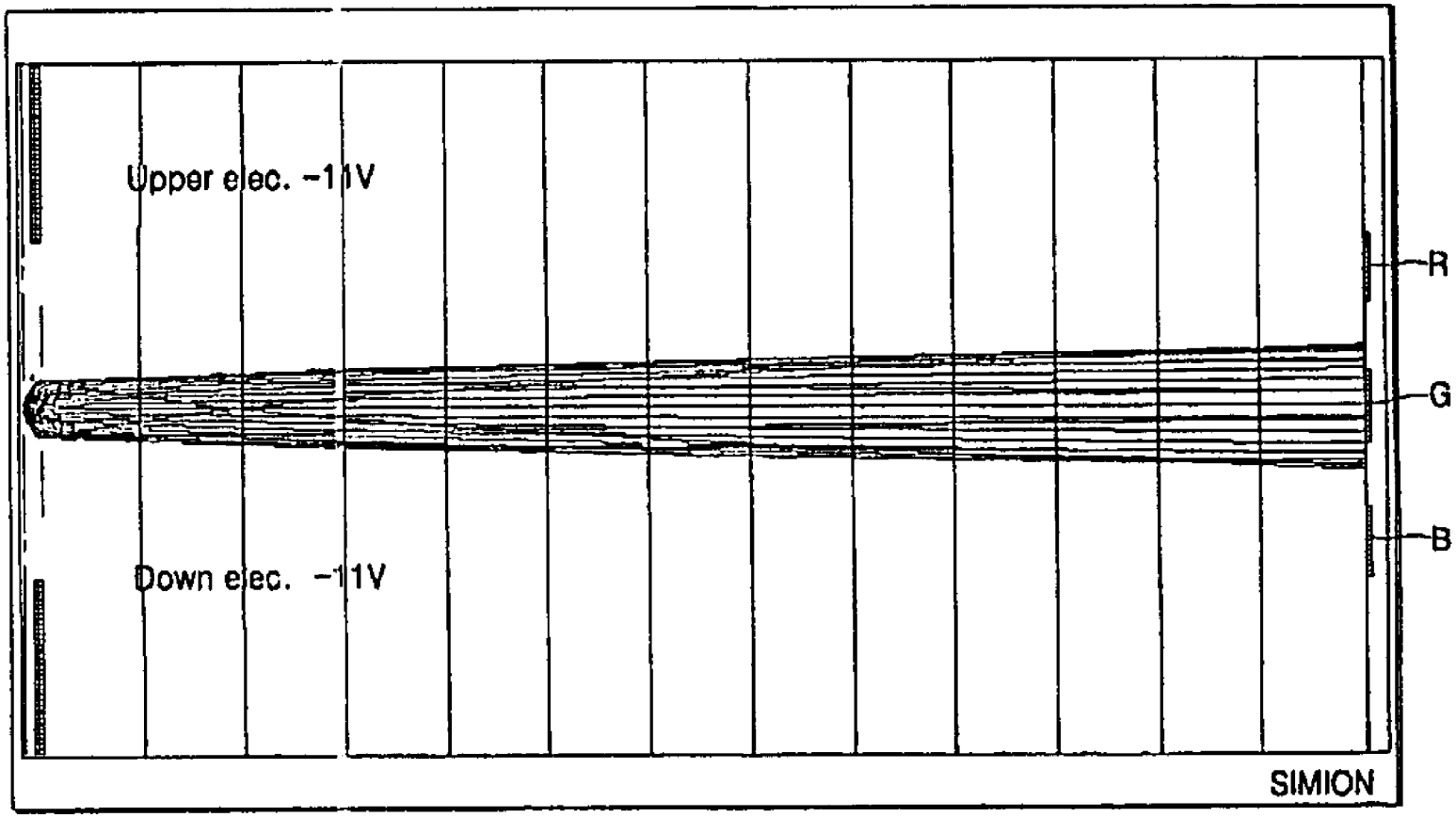
FIG. 15 is a view illustrating a trajectory of an electron beam emitted when a voltage of a G deflection mode is applied to a deflection electrode of a field emission display equipped with the deflection electrode according to the present invention.

Turning now to FIG. 15, FIG. 15 is a view illustrating a trajectory of an electron beam emitted when a voltage of a G deflection mode is applied to the deflection electrode of a field emission display equipped with the deflection electrode according to the present invention.

In detail, FIG. 15 illustrates an electron beam trajectory simulation result when a gate voltage is 180V, an anode voltage is 2.5 kV, and −11V is applied to the first and second elements of the deflection electrodes. As can be seen from FIG. 15, the electron beam is not deflected but is transferred straight to a G phosphor layer when the same voltage of −11V is applied to both the first and second deflection electrodes.

Figure 16:
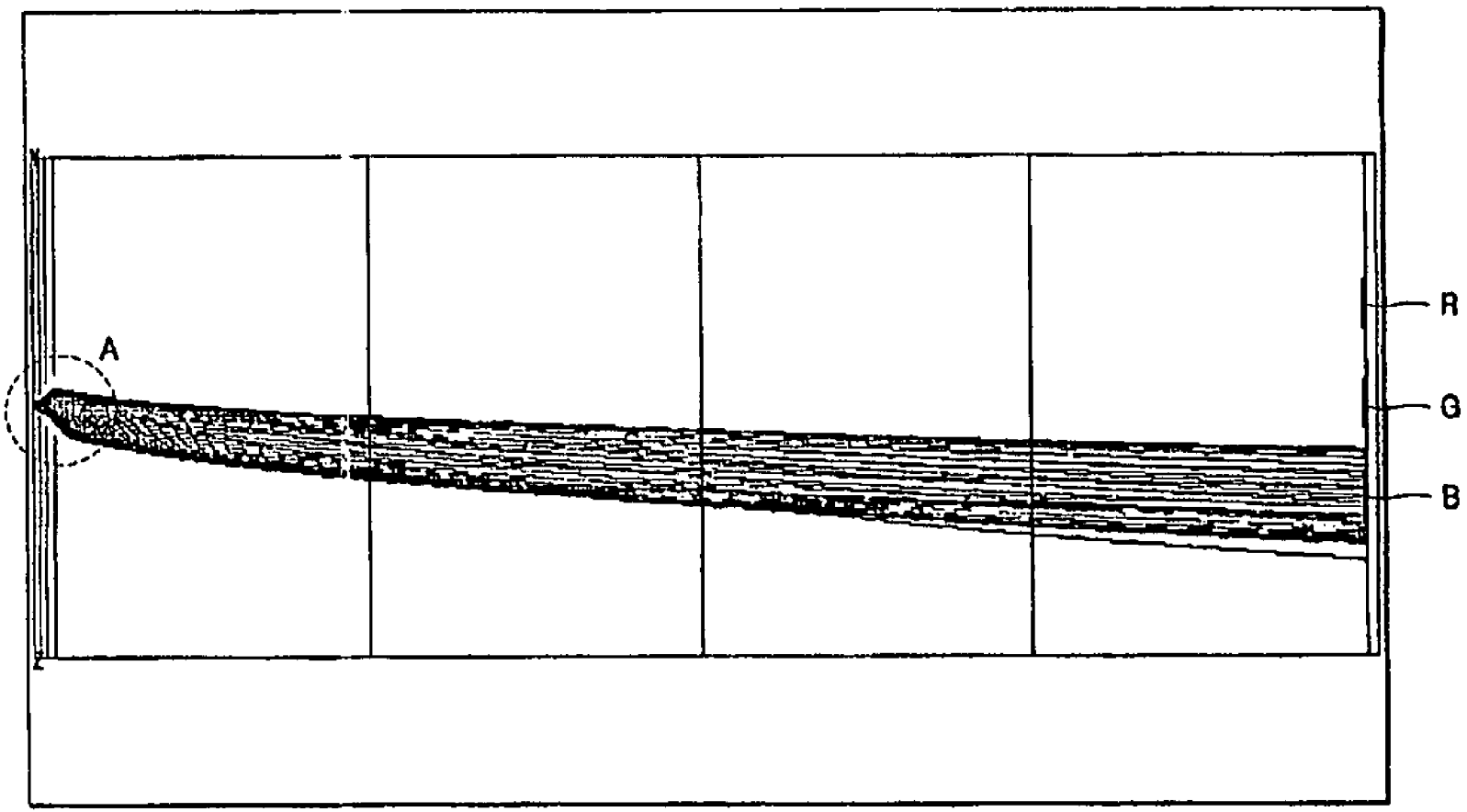
FIG. 16 is a view illustrating a trajectory of an electron beam emitted when a voltage of a B deflection mode is applied to a deflection electrode of a field emission display equipped with the deflection electrode and a protective electrode according to the present invention.

Turning now to FIG. 16, FIG. 16 is a view illustrating a trajectory an electron beam when a voltage of a B deflection mode is applied to a deflection electrode of a field emission display equipped with the deflection electrode and the protective electrode according to the present invention. Specifically, FIG. 16 illustrates an electron beam trajectory simulation result when a distance between the front and rear substrates is 1500 μm, a gate voltage is 80V, an anode voltage is 2.5 kV, a voltage of the protective electrode shown in FIG. 11 is −15V, and +130V and −75V are applied respectively to the first and second elements of the deflection electrodes. It can be seen from the simulation result of FIG. 16, the electron beam emitted from the emitter is deflected toward the first element 553 (electrode at a lower portion of FIG. 16) of a higher voltage so that it lands on a B phosphor layer.

Figure 17:
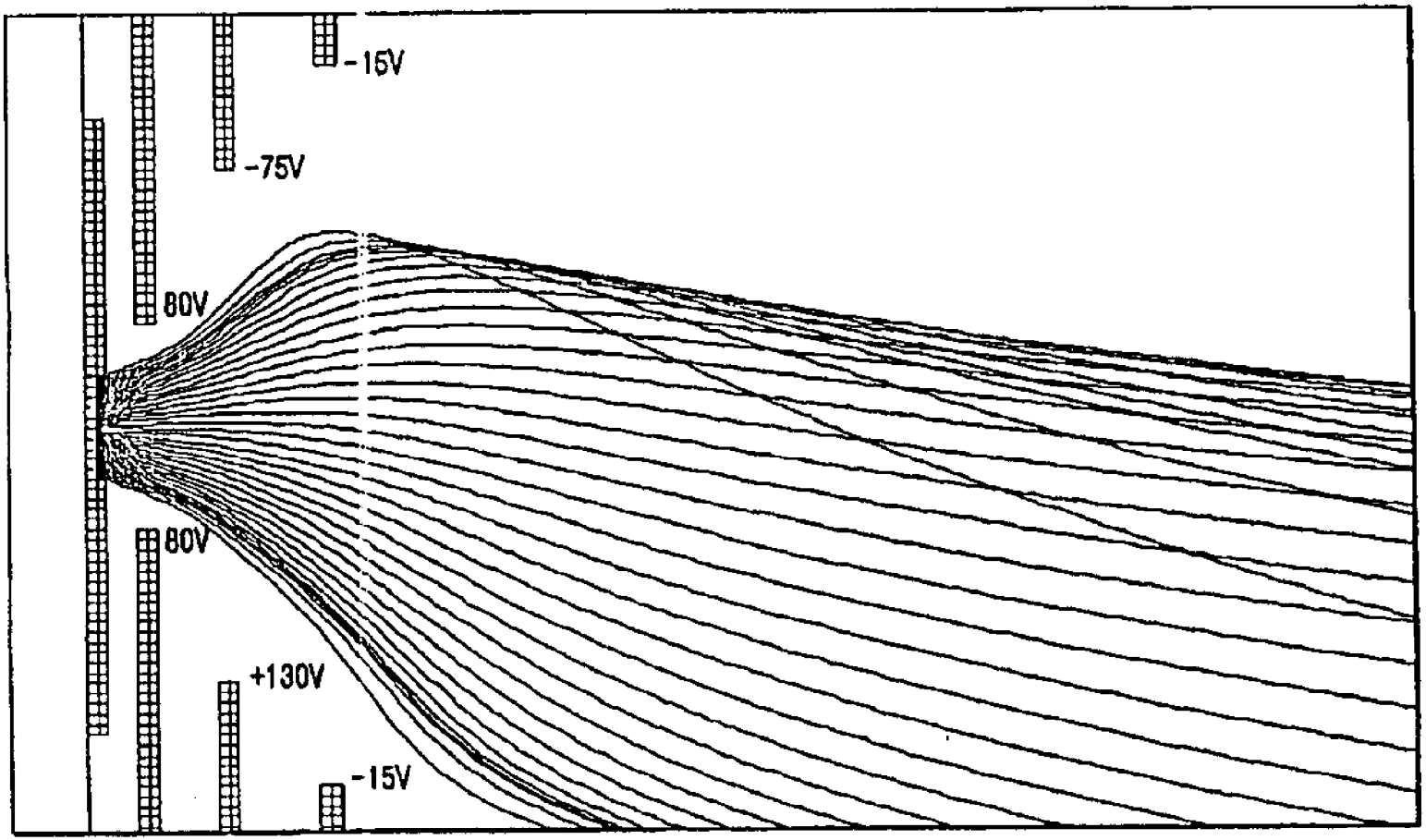
FIG. 17 is an enlarged view of an area 'A' shown in FIG. 16.

Turning now to FIG. 17, FIG. 17 is an enlarged view of an area 'A' shown in FIG. 16. Referring to FIG. 17, a trajectory of an electron beam traveling at the left side of FIG. 16 is deflected toward the first element of a high voltage +130V and then focused at the center side without being dispersed by the protective electrode (−15V). In this manner, the protective electrode not only can prevent the accumulation of a positive charge on a surface of the cold cathode device, but also can focus the electron beam.

In addition, the deflection voltage controlling unit can increase/decrease a voltage of one of at least two elements of the deflection electrodes by the same magnitude with respect to all the deflection modes. Accordingly, arrival locations of electron beams for all the colors can be horizontally shifted. Therefore, a possible misalignment between the rear and front substrates can be compensated for by such an electrical adjustment.

Figure 18A:
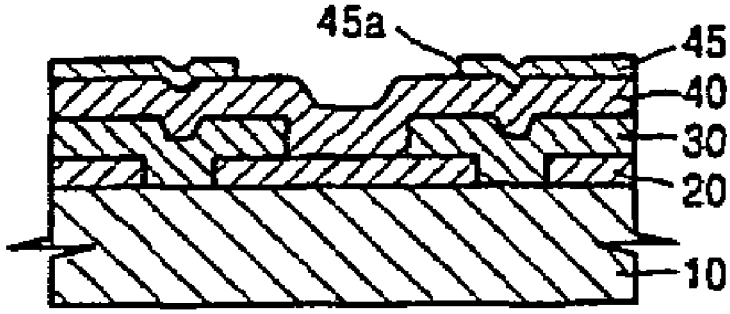
FIGS. 18A through 18D are sectional views illustrating a manufacturing method of a field emission display equipped with a deflection electrode according to the present invention.

A method of manufacturing the inventive field emission display will now be described in detail. FIGS. 18A through 18D are sectional views illustrating a manufacturing process for a field emission display equipped with a deflection electrode according to the present invention. Referring first to FIG. 18A, a cathode layer 20 is formed on a rear substrate and then pattered. A ballast resistor layer 30, a first dielectric layer 40 and a gate electrode 45 are formed on the cathode layer 20 and then patterned.

The ballast resistor 30 can be made of material having resistivity of about 100 Ω·cm through 107 Ω·cm, such as amorphous silicon and the like. The dielectric layer 40 is made mainly of silica ($SiO_2$). A metal electrode such as the gate electrode 45 is formed by depositing chrome (Cr) and patterning the resulting layer. When the gate electrode 45 is patterned, a gate aperture 45*a* corresponding to an emitter is formed in the gate electrode 45.

Figure 18B:
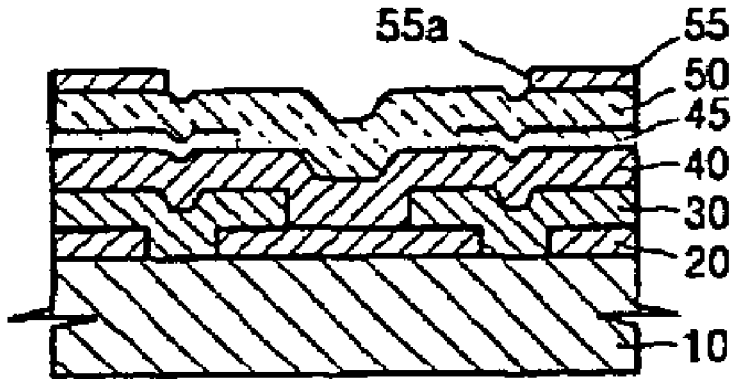

Referring to FIG. 18B, a second dielectric layer 50 and a deflection electrode 55 are formed on the gate electrode 45. The deflection electrode 55 is patterned to be symmetrically divided into two parts with the emitter between them so that different voltages can be applied to the two parts.

Figure 18C:
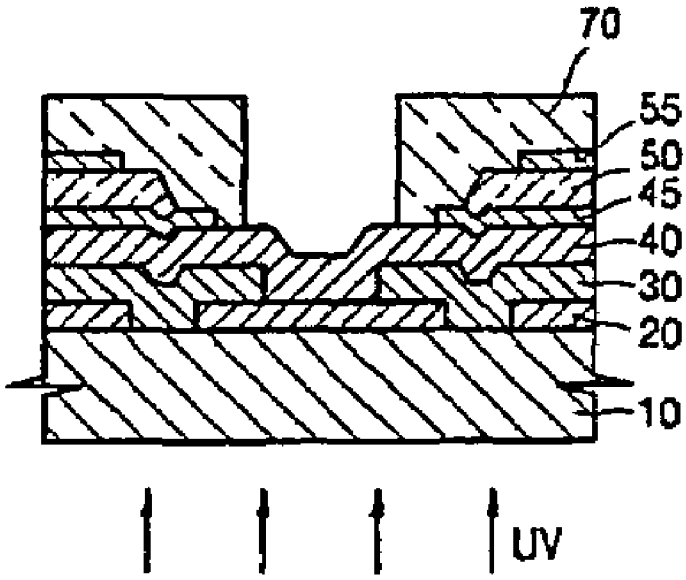

Referring to FIG. 18C, the second dielectric layer 50 and the first dielectric layer 40 are etched, and a sacrificial photoresist layer is formed on an upper surface of the deflection electrode 55 and on an inner surface of an emitter aperture. Thereafter, a predetermined portion of a cathode 20 is exposed by removing the first dielectric layer 40 in the hole using a back-side exposure technique. At this time, the resistive element formed of amorphous silicon serves as a photolithographic mask that enables the cathode 20 to be selectively exposed.

Figure 18D:
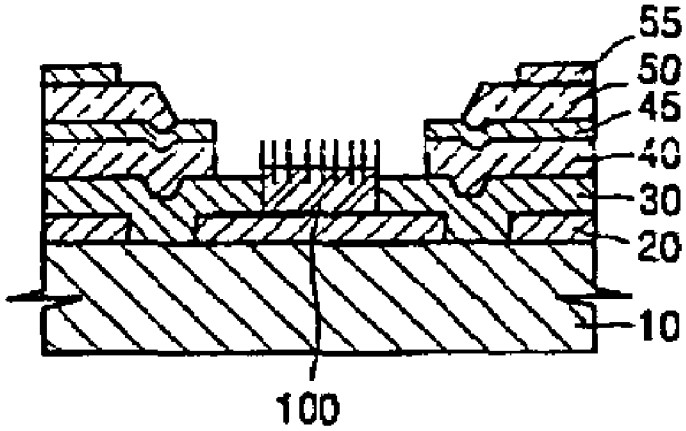
Figure 19A:
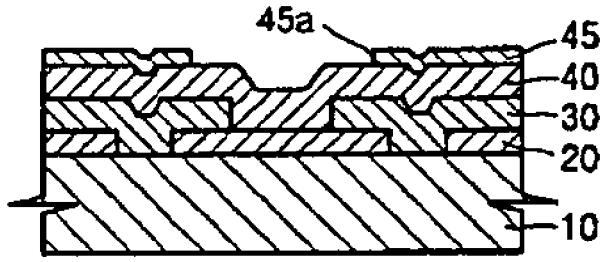
FIGS. 19A through 19E are sectional views illustrating a manufacturing method of a field emission display equipped with a deflection electrode and a protective electrode according to the present invention.
Figure 19B:
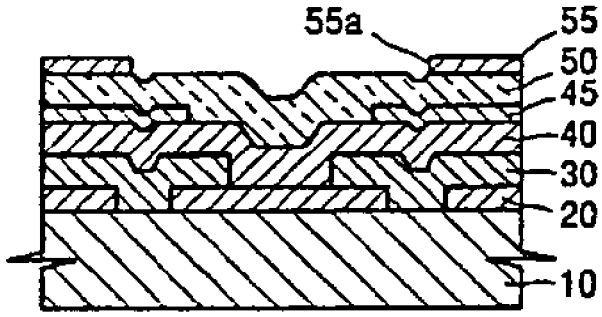
Figure 19C:
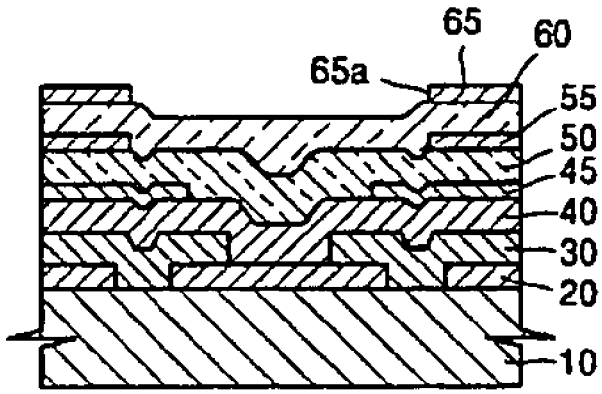
Figure 19D:
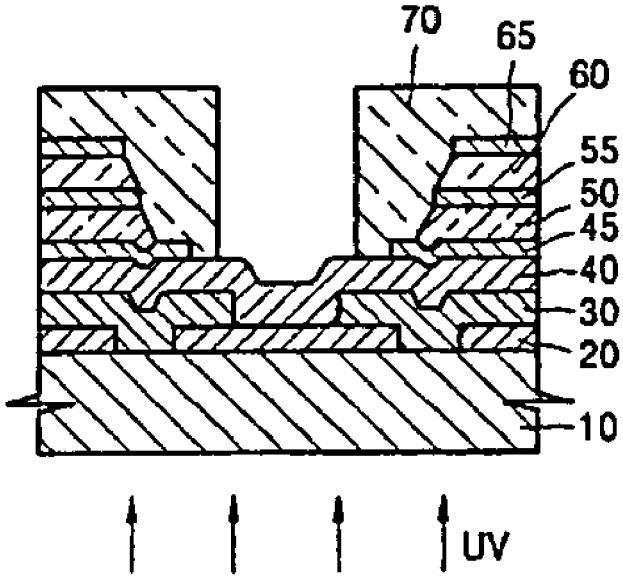
Figure 19E:
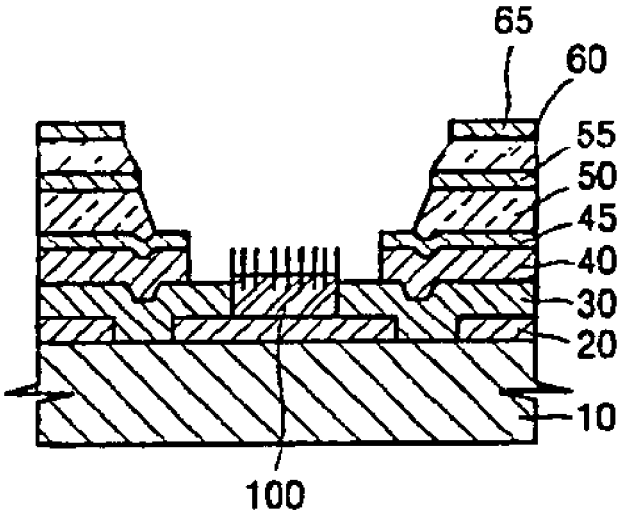

Referring to FIG. 18D, a carbon nanotube emitter 100 is formed on a portion of cathode 20 that is exposed at the bottom of the emitter aperture. The carbon nanotube emitter 100 can be formed by coating carbon nanotube paste on an inner surface of the aperture and then performing a UV exposure and a firing process on the resulting structure.

FIGS. 19A through 19E are sectional views illustrating a manufacturing process for a field emission display equipped with a deflection electrode and a protective electrode according to the present invention. The manufacturing process in FIGS. 19A through 19E is generally the same as that the process of FIGS. 18A through 18D. When compared with the manufacturing process of FIGS. 18A through 18D, the manufacturing process in FIGS. 19A through 19E further includes forming a third dielectric layer 60 and a protective electrode 65*a* on the deflection electrode 55. The protective electrode 65 is formed in a body with respect to an entire surface of the rear substrate 10, and an aperture 65*a* corresponding to an emitter is formed through a patterning process. The aperture 65*a* preferably has a round shape.

As stated above, the direction of the electron beam can be controlled by providing the deflection electrode capable and applying relatively low voltages thereto to control the direction of the electron beam emanating from the rear substrate. Also, a possible misalignment between the front substrate and the rear substrate during a packaging process can be corrected through a simple method of uniformly adjusting a voltage applied to the deflection electrode.

Further, a sufficient data line width can be obtained even in a high-resolution device because emitters are in 1:1 correspondence with pixels, and a sufficient luminance can be obtained by applying a high voltage because a voltage of the anode need not be switched.

Furthermore, the cold cathode device on the rear substrate can be protected from charged particles generated in the display through a high voltage by providing a protective electrode formed in a body with respect to an entire surface of an uppermost layer of the rear substrate so that the lifetime and reliability of the field emission display can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission display, comprising:

a rear substrate;

a cathode arranged on the rear substrate;

an emitter arranged on the cathode;

a first dielectric layer arranged on the cathode, a first through hole corresponding to the emitter being arranged in the first dielectric layer;

a gate electrode arranged on the first dielectric layer, a gate aperture corresponding to the emitter being arranged in the gate electrode;

a second dielectric layer arranged on the gate electrode, a second through hole corresponding to the emitter being arranged in the second dielectric layer; and a deflection electrode arranged on the second dielectric layer, the deflection electrode having at least two elements symmetrically arranged to face each other with the emitter therebetween, the deflection electrode being configured to guide an electron beam emanating from the emitter to different subpixels by varying a difference in electric potential applied between a first of the two elements and a second of the two elements.

2. The display of claim 1, wherein the two elements are electrically isolated from each other and are adapted to be held at electric potentials that are different from each other at any point in time.

3. The display of claim 1, wherein the second through hole is arranged to have a round shape and the two elements of the deflection electrode comprise facing arc portions arranged at inner sides thereof.

4. The display of claim 1, wherein the deflection electrode comprises facing straight lines passing by both sides of the second through hole.

5. The display of claim 1, further comprising a resistive element arranged between the cathode and the emitter, the resistive element being configured to enable electrons to be transferred from the cathode uniformly to all parts of the emitter.

6. A field emission display, comprising:

a rear substrate;

a cathode arranged on the rear substrate in parallel stripes;

an emitter arranged on the cathode and spaced apart from the cathode;

a first dielectric layer arranged on the cathode, a first through hole corresponding to the emitter being arranged in the first dielectric layer;

a gate electrode arranged on the first dielectric layer in parallel stripes intersecting the parallel stripes of the cathode, a gate aperture corresponding to the emitter being arranged in the gate electrode;

a second dielectric layer arranged on the gate electrode, a second through hole corresponding to the emitter being arranged in the second dielectric layer;

a deflection electrode arranged on the second dielectric layer intersecting the gate electrode and extending in parallel with the cathode, the deflection electrode having at least two elements symmetrically arranged to face each other with the emitter therebetween;

a third dielectric layer arranged on the deflection electrode, a third through hole corresponding to the emitter being arranged in the third dielectric layer; and a protective electrode arranged on the third dielectric layer, the protective electrode having a hole corresponding to the emitter.

7. The display of claim 6, wherein the protective electrode is arranged in a body with respect to an entire surface of the rear substrate.

8. The display of claim 6, wherein the second through hole is arranged to have a round shape and the two elements of the deflection electrode comprise facing arc portions arranged at inner sides thereof.

9. The display of claim 6, wherein the deflection electrode comprises facing straight lines passing by both sides of the second through hole.

10. The display of claim 6, further comprising a resistive element arranged between the cathode and the emitter and being configured to enable electrons to be transferred from the cathode uniformly to all parts of the emitter.

11. A field emission display, comprising:

a rear substrate;

a cathode arranged on the rear substrate;

an emitter arranged on the cathode;

a first dielectric layer arranged on the cathode, a first through hole corresponding to the emitter being arranged in the first dielectric layer;

a gate electrode arranged on the first dielectric layer, a gate aperture corresponding to the emitter being arranged in the gate electrode;

a second dielectric layer arranged on the gate electrode, a second through hole corresponding to the emitter being arranged in the second dielectric layer;

a deflection electrode arranged on the second dielectric layer, the deflection electrode having at least two elements symmetrically arranged to face each other with the emitter therebetween; and a deflection voltage controlling unit configured to cause an electron beam emanating from the emitter to deflect to different subpixels at different points in time by varying a difference in voltages applied between the two elements at a corresponding different points in time.

12. The display of claim 11, wherein one of the subpixels corresponds to an electron beam not deflected by the deflection electrode.

13. The display of claim 11, wherein the second through hole is arranged to have a round shape and the two elements of the deflection electrode comprise facing arc portions arranged at inner sides thereof.

14. The display of claim 11, wherein the deflection electrode comprises facing straight lines passing by both sides of the second through hole.

15. The display of claim 11, further comprising a resistive element arranged between the cathode and the emitter and being configured to enable electrons to be transferred from the cathode uniformly to all parts of the emitter.

16. The display of claim 11, wherein the deflection electrode comprises a first element and a second element, the deflection voltage controlling unit being configured to apply voltages of three deflection modes, the three deflection modes comprise a R deflection mode where a voltage of the first element of the deflection electrode is lower than a voltage of the second element of the deflection electrode, a G deflection mode where a voltage of the first element of the deflection electrode is identical to a voltage of the second element of the deflection electrode, and a B deflection mode where a voltage of the first element of the deflection electrode is higher than a voltage of the second element of the deflection electrode.

17. The display of claim 16, the deflection voltage controlling unit is configured to sequentially apply voltage of the three deflection modes during each frame period.

18. The display of claim 11, the deflection voltage controlling unit is configured to horizontally shift arrival locations of electron beams by uniformly adjusting a voltage of one of at least the two elements of the deflection electrode with respect to all the deflection modes.

19. A field emission display, comprising:

a rear substrate;

a cathode arranged on the rear substrate;

an emitter arranged on the cathode;

a first dielectric layer arranged on the cathode, a first through hole corresponding to the emitter being arranged in the first dielectric layer;

a gate electrode arranged on the first dielectric layer, a gate aperture corresponding to the emitter being arranged in the gate electrode;

a second dielectric layer arranged on the gate electrode, a second through hole corresponding to the emitter being arranged in the second dielectric layer;

a deflection electrode arranged on the second dielectric layer, the deflection electrode having at least two elements symmetrically arranged to face each other with the emitter therebetween;

a third dielectric layer arranged on the deflection electrode, a third through hole corresponding to the emitter being arranged in the third dielectric layer;

a protective electrode arranged on the third dielectric layer, the protective electrode having a hole corresponding to the emitter; and a deflection voltage controlling unit configured to apply voltages of several deflection modes to the deflection electrode to cause an electron beam emanating from the emitter to deflect to different subpixels at different points in time by varying a difference in voltages applied between the two elements at a corresponding different points in time.

20. The display of claim 19, wherein the second through hole is arranged to have a round shape and the two elements of the deflection electrode comprises facing arc portions arranged at inner sides thereof.

21. The display of claim 19, wherein the deflection electrode is arranged to have facing straight lines passing by both sides of the second through hole.

22. The display of claim 19, further comprising a resistive element arranged between the cathode and the emitter, the resistive element being configured to enable electrons to be transferred from the cathode uniformly to all parts of the emitter.

23. The plasma display of claim 19, wherein the deflection electrode comprises a first element and a second element, the deflection voltage controlling unit being configured to apply voltages of three deflection modes, the three deflection modes comprise a R deflection mode where a voltage of the first element of the deflection electrode is lower than a voltage of the second element of the deflection electrode, a G deflection mode where a voltage of the first element of the deflection electrode is identical to a voltage of the second element of the deflection electrode, and a B deflection mode where a voltage of the first element of the deflection electrode is higher than a voltage of the second element of the deflection electrode.

24. The display of claim 23, wherein the deflection voltage controlling unit is configured to sequentially apply voltage of the three deflection modes during each frame period.

25. The display of claim 19, wherein the deflection voltage controlling unit is configured to horizontally shift arrival locations of electron beams by uniformly adjusting a voltage of one of at least the two elements of the deflection electrode with respect to all the deflection modes.

* * * * *